United States Patent [19]

Klocker

[11] Patent Number: 4,967,802

[45] Date of Patent: Nov. 6, 1990

[54] DEVICE FOR FORMING A LENO WEAVE SELVAGE

[75] Inventor: Heinz J. Klocker, Borken/Westf., Fed. Rep. of Germany

[73] Assignee: Klocker-Entwicklungs-GmbH, Borken/Westf, Fed. Rep. of Germany

[21] Appl. No.: 357,547

[22] Filed: May 26, 1989

[30] Foreign Application Priority Data

Jun. 1, 1988 [DE] Fed. Rep. of Germany ..... 3818680

[51] Int. Cl.[5] ..... D03C 7/00

[52] U.S. Cl. ..... 139/51; 139/54

[58] Field of Search ..... 139/50, 51, 52, 53, 139/54

[56] References Cited

U.S. PATENT DOCUMENTS 776,300 11/1904 Cowan ..... 139/51
3,015,346 1/1962 Kaufmann ..... 139/52
3,353,569 11/1967 Koch ..... 139/51
3,990,481 11/1976 Graf .

FOREIGN PATENT DOCUMENTS 877205 9/1961 United Kingdom ..... 139/52

*Primary Examiner*—Andrew M. Falik
*Attorney, Agent, or Firm*—Collard, Roe & Galgano

[57] ABSTRACT

A device for forming a leno weave selvage, having heald frames which reciprocate wherein at least two lifting healds which are disposed adjacent to each other include a half heald which is alternatively guided by the reciprocating lifting healds. In one embodiment magnets are disposed on the lifting healds and in magnetic contact with the half heald for alternatively moving the half heald. In another embodiment elastic elements connect the half heald to the lifting healds for moving the lifting healds. The elastic elements could also be connected to the heald frames for moving the half healds. The elastic elements may comprise rubber bands.

10 Claims, 6 Drawing Sheets

DEVICE FOR FORMING A LENO WEAVE SELVAGE

This invention relates to a device for forming a leno weave selvage, using reciprocating heald frames.

DESCRIPTION OF THE PRIOR ART

A conventional device that forms a leno weave selvage consists of two standard lifting healds and a half heald or doup, and a control mechanism for the half heald. In this design, the lifting healds are attached directly to the heald frames or shafts and reciprocate. The control mechanism for the half heald consists of a braid carrier held in place by a spring.

This device for forming a leno weave selvage has the disadvantage of using an extremely heavy control mechanism for the half heald, consisting of a braid carrier and a spring. The heavy weight of the entire device places a natural limit on increasing the stroke rate, since the kinetic energy for accelerating and decelerating the masses becomes too large.

In addition, it has turned out to be a disadvantage that, during the entire stroke motion of a lifting heald, the half heald carried along by that lifting heald is continually exposed to the effect of the spring force of the braid carrier. This causes an extreme and rapid wear of the lifting healds in the area of the guide openings for the half healds or doups. Some prior art patents for making selvage edge or borders are U.S. Pat. Nos. 4,072,174; 3,871,414; 3,255,783; 4,478,256; 3,191,634; 3,741,256 and 3,256,913.

BRIEF DESCRIPTION OF THE INVENTION

It is therefore an object of the invention to provide a device for forming a leno weave border or selvage which is lighter than conventional devices, and which experiences less wear of the lifting healds.

Accordingly, the invention provides a design where the entire device for forming a leno weave selvage consists merely of two reciprocating lifting healds, and one half heald which is guided by the lifting healds, and is alternatingly carried along by one or the other of the lifting healds. The half heald consists essentially of two arms, which at one end form a closed eye for carrying the leno thread. Each arm of the half heald is guided by a guidance opening located in the lifting heald, formed by two stacked flanges laterally offset from each other.

In one embodiment, the lifting healds can be suspended in the heald frames with the eye of the half heald pointing upward. In this case, the motion of the half heald in the lifting healds is controlled both by the force of gravity acting on the half heald, and by the tension of the leno thread passing through the eye. It will be evident that the control of the motion of the half heald by way of the tension of the leno thread will occur even without the additional effect of gravity. This occurs when the lifting healds with the half heald are attached to the heald frames with the opening of the half heald pointing downward. The known means for controlling the motion of the half heald, namely the braid carrier with its spring, are no longer needed in this design. The disadvantages associated with these means thus do not apply. Consequently, as a result of the extremely low weight of the entire device, the stroke rate can be increased.

As an additional advantage, a large number of lifting healds can be attached to the heald frames adjacent to each other. According to the known state of technology, no more than four lifting healds could be attached to the heald frames adjacent to each other. Otherwise, the force of the spring had to be increased. Moreover, an increase in the number of lifting healds according to the known state of technology is prevented by the available space on the braid carrier.

In a particularly advantageous embodiment of the invention, motion control devices are provided for controlling the doup or half heald. In this embodiment, neither the effect of gravity nor the tension of the leno thread are very significant, since the motion control device will insure under all cicumstances, that the half heald is carried along alternatingly by the lifting healds.

According to a particularly advantageous form of this embodiment, the devices for controlling the motion of the half heald consist of magnets situated in the standard lifting healds. In this design, the distance of the magnets situated in the lifting healds from the interior bridge of the guide opening corresponds approximately to the arm length of the half heald. In order to generate the magnetic force for motion control, the half heald must consist of a magnetic metal, or be equipped with a suitable inlay. Even at high stroke rates, this device insures an accurate control of half heald motion.

Furthermore, there is little wear of the interior bridge of the guide opening of a lifting heald due to the force acting on the bridge of the half heald while it is being carried along. This bridge of the guide opening of the lifting heald, in contrast to the conventional control mechanism design using a braid carrier and a spring, is under the effect of the force caused by the magnets only at the point in time when the motion reversal is initiated. Thus, the effect of gravity of the half heald on the wear of the bridge is negligibly small.

According to a second embodiment, the half heald is connected to the lifting healds or to the heald frames themselves by means of elastic elements, such as rubber bands, for motion control. Compared to conventional devices for forming a leno weave selvage, the weight of this device also is many times reduced. Even though the interior bridge of the guide opening of the lifting heald is exposed to the load of these elastic elements during the entire path of motion of the lifting heald, the resultant force is much less than the force acting on the bridge in conventional motion control devices, consisting of a braid carrier and a spring, since the rubber bands, due to their low weight, can also be of lighter dimension.

Other objects and features of the present invention will become apparent from the following detailed description considered in connection with the accompanying drawing, which discloses the embodiment of the invention.

BRIEF DESCRIPTION OF THE DRAWINGS

In the drawing, wherein similar reference characters denote similar elements throughout the four views.

DETAILED DESCRIPTION OF THE INVENTION

Figure 1:
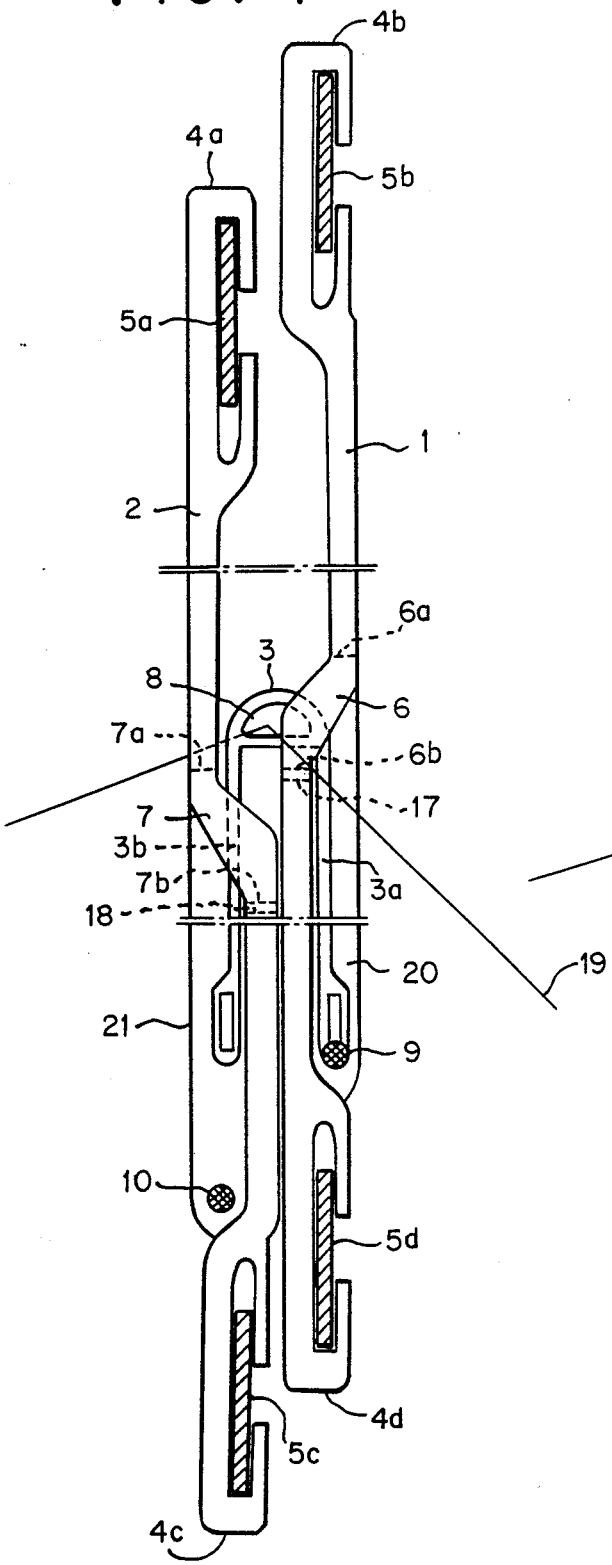
FIG. 1 shows a partial section front view of a first embodiment of the invention where the control of the motion of the half heald is effected by means of magnets situated in the lifting healds.

Referring to FIGS. 1-4, there is shown lifting healds 1 and 2 and a half heald 3 controlled by lifting healds 1 and 2. Lifting healds 1 and 2 have at their ends, slots 4*a*-4*d* for attachment to heald frames 5*a*-5*d* which move reciprocatingly. Each lifting heald 1 and 2 has a guide opening 6 and 7 formed by flanges 6*a*, 6*b* and 7*a*, 7*b*. Half heald 3 consists essentially of two arms 3*a* and 3*b*, forming a closed eye 8 at their upper end to hold the leno thread 19.

In the first embodiment as shown in FIG. 1, motion control is effected by means of the magnets 9, 10 situated in shell 20, 21 of lifting healds 1 and 2. Half heald 3 is carried along by interior bridges 6*b* and 7*b* of guide openings 6 and 7, which alternatingly grasp half heald 3 in the area of eye 8. In order to insure that the half heald is properly controlled and carried along by the lifting healds, the distance between magnet 9 or 10 and the interior bridge 6*b* or 7*b* of each guide opening 6 or 7 corresponds approximately to the length of an arm 3*a*, 3*b* of half heald 3.

Figure 2:
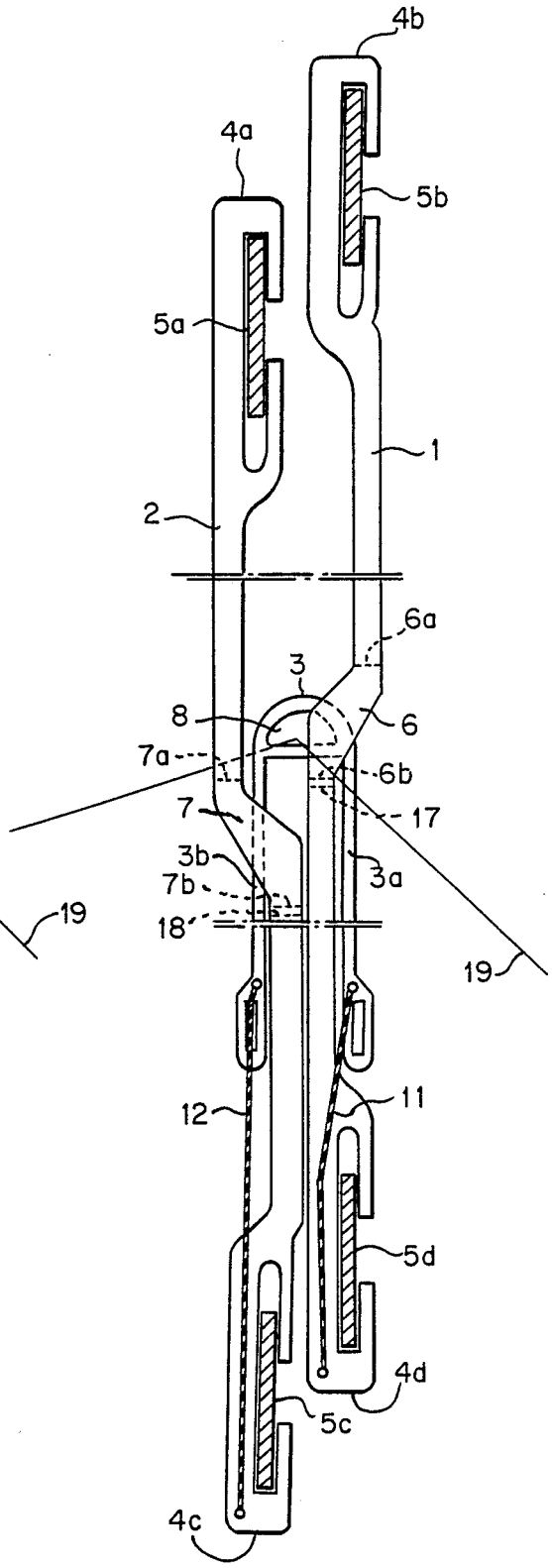
FIG. 2 shows a partial section front view of a second embodiment of the invention where the control of half heald is effected by means of rubber bands attached to the lifting healds.

In a second embodiment of the invention, the magnets are replaced by rubber bands 11 and 12 for motion control, whereby arms 3*a*, 3*b* of the half heald are connected to the lifting heald (see FIG. 2). The process of motion control in this case is the same as in the first embodiment.

Figure 3:
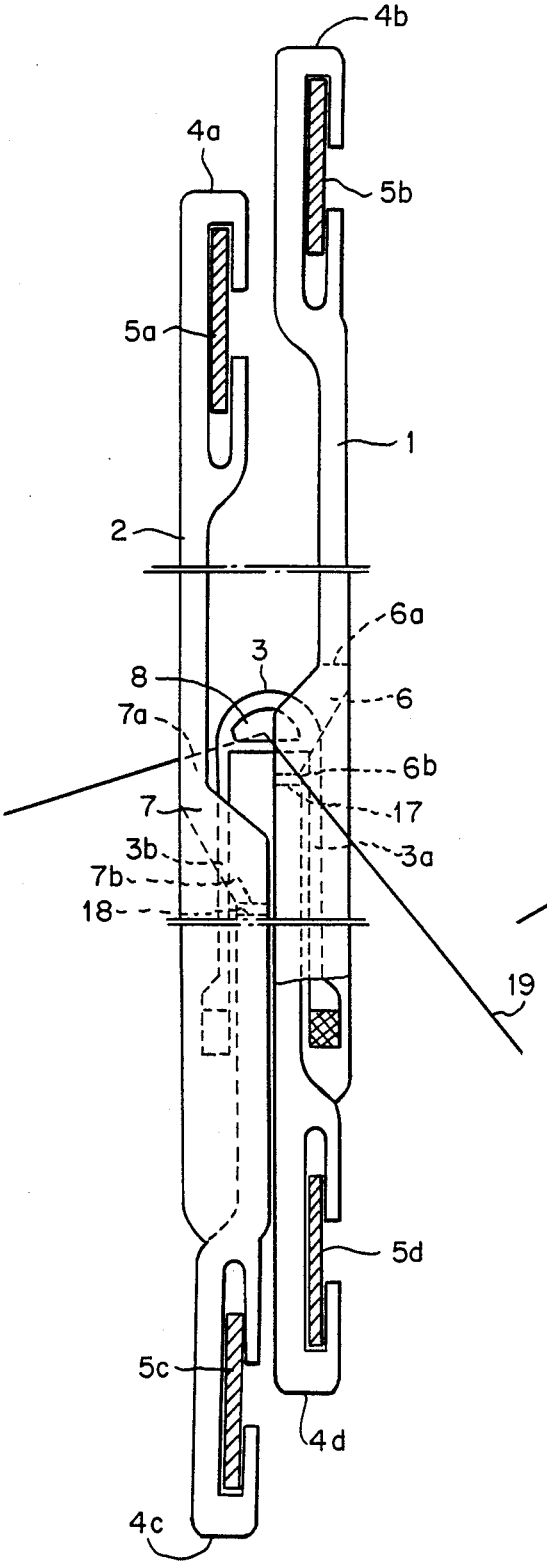
FIG. 3 shows a partial section front view of a third embodiment of the invention where the motion of the half heald, which is suitably mounted on the heald frames that move reciprocatingly, is controlled by gravity, and by the tension of the leno thread.

In the embodiment of FIG. 3, motion control is effected only through the force of gravity acting on the half heald 3, plus an appropriate tensioning of the leno thread passing through eye 8 of half heald 3. In this embodiment, the half heald is guided and carried along by bridges 6*b* and 7*b* of the guide openings 6 and 7, respectively.

Figure 4:
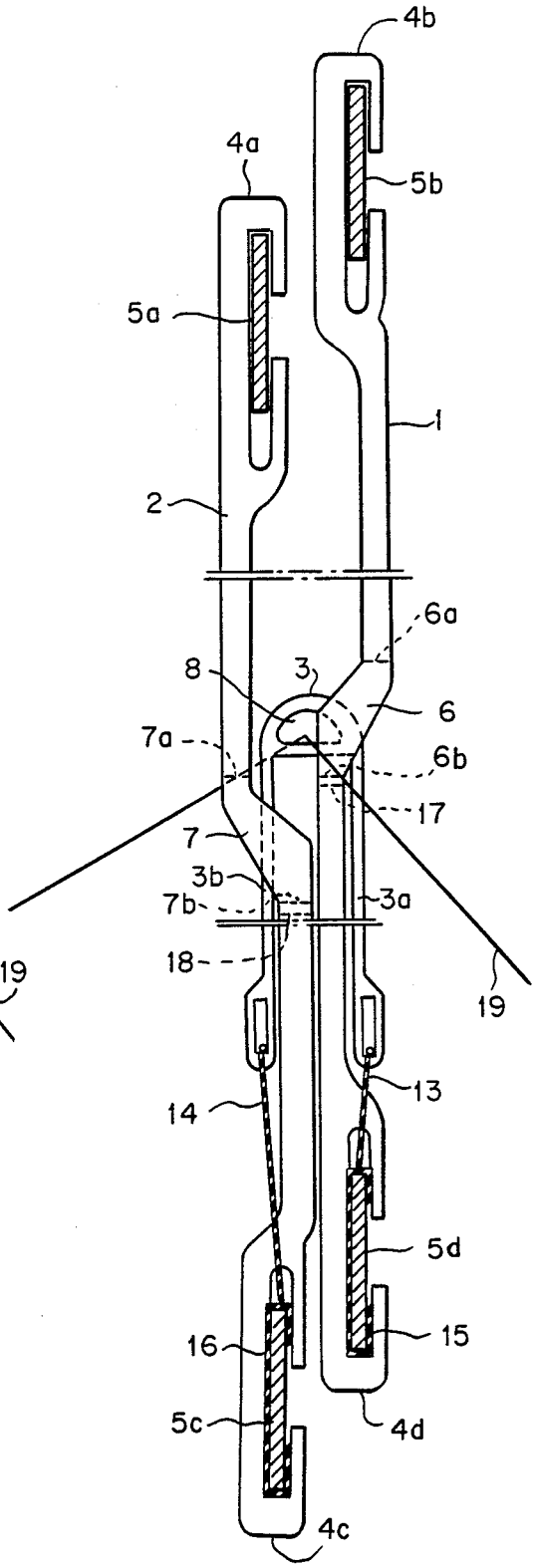
FIG. 4 shows a partial section front view of a fourth embodiment of the invention where the control of half heald is effected by means of rubber bands attached to the heald frames; and, FIG. 5 shows a lifting heald with a half heald frontal view.
Figure 5:
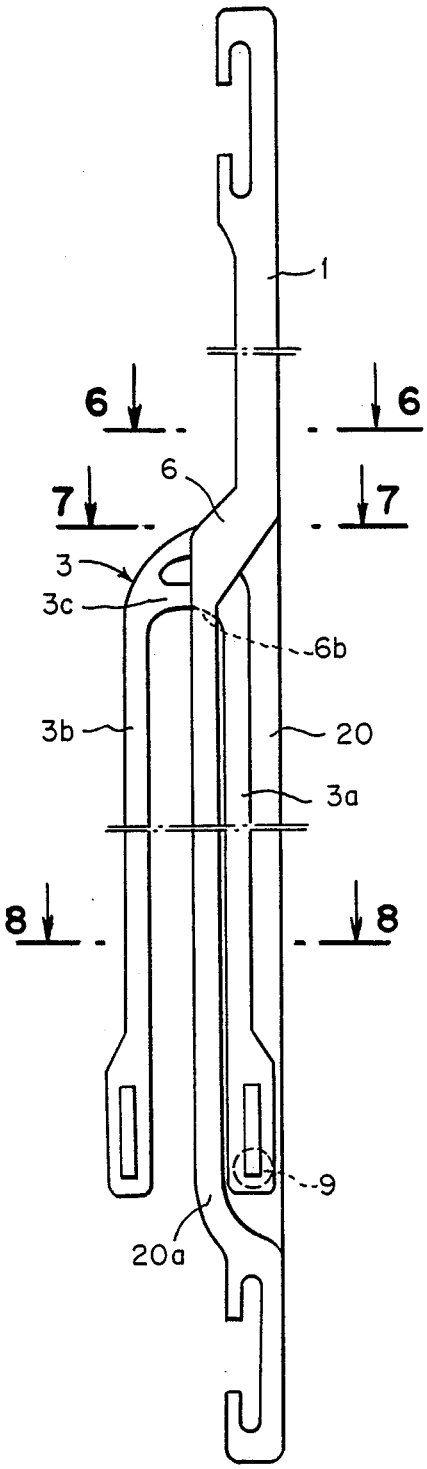
Figure 6:
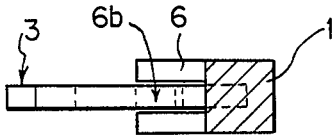
FIG. 6 shows a section view along the line 6—6 of FIG. 5.

The fourth embodiment of FIG. 4 differs from the embodiment shown in FIG. 2 only by the fact that the rubber bands 13, 14 are directly attached to the heald frames 5*c*, 5*d* by means of clamping devices 15, 16.

In order to further reduce the wear of the interior bridges 6*b*, 7*b* (which is already low), these bridges are fitted with reinforcing inlays 17, 18, made of a material such as metal.

Figure 7:
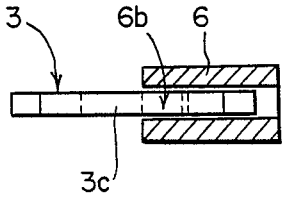
FIG. 7 shows a section view along the line 7—7 of FIG. 5.
Figure 8:
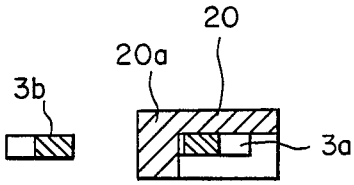
FIG. 8 shows a section view along the line 8—8 of FIG. 5.

In the drawing, FIGS. 7 and 8 are depicted on a greatly enlarged scale. As can be appreciated from FIGS. 5 through 8, the shell or casing 20 is a component part of the lifting heald. This casing 20 is used to guide the corresponding shank 3*b* of the half heald 3 and also to receive the magnet 9 which is responsible for controlling the half heald 3. The inner arm 6*b* of the lifting heald is that part on which the arm 3*c* of the half heald 3 bears during the entraining motion effected by the lifting heald.

While only a few embodiments of the present invention have been shown and described, it will be obvious that many changes and modifications may be made therein to without departing from the sphere and scope of the invention.

What is claimed is:

1. A device for forming a leno weave selvage, having heald frames which reciprocate, comprising at least two alternatively moveable lifting healds disposed adjacent to each other, and a half heald there between which is guided by said reciprocating lifting healds and carried along alternatively by one of said lifting healds, and connecting means connecting the half heald to the lifting heald for controlling the motion of the half heald by the movement of the lifting healds.

2. The device according to claim 1, comprising electric elastic elements for connecting said half heald to said lifting healds for motion control of said half heald.

3. The device according to claim 1, comprising elastic elements for connecting said heald frames to said half heald for motion control of the half heald.

4. The device according to claim 3, wherein said elastic elements comprise rubber bands.

5. The device according to claim 4, comprising clamping devices for connecting the rubber bands to said heald frames.

6. The device according to claim 1, wherein each lifting heald has an interior bridge and has a guide opening for the half heald, said opening being formed by two stacked flanges on each lifting heald, said flanges being laterally offset against each other, so that one of the interior bridges grasps said half heald in the area of the eye.

7. A device for forming a leno weave selvage, having heald frames which reciprocate, comprising at least two lifting healds disposed adjacent to each other, and a half heald which is guided by said reciprocating lifting healds and carried along alternatively by one of said lifting heads;

means for controlling the motion of the half heald by the lifting healds, said means for controlling including magnets disposed on the lifting healds and in magnetic contact with said half heald.

8. The device according to claim 7, wherein each lifting heald is provided with a shell for carrying said magnets.

9. The device according to claim 8, wherein each lifting heald has an interior bridge;

wherein said half heald has at least one arm which has a length, and wherein the distance between the magnets situated in the shells of each lifting heald and the interior bridge, corresponds approximately to the arm length of said half heald.

10. The device according to claim 9, comprising reinforcing inlays disposed in the interior bridges of said lifting healds.

* * * * *